US005379944A

United States Patent [19]

Stout et al.

[11] Patent Number: 5,379,944

[45] Date of Patent: Jan. 10, 1995

[54] HEAVY DUTY ARTICLE CARRIER

[75] Inventors: James T. Stout, Ellijay, Ga.; James B. DeMaio, Henderson, Nev.

[73] Assignee: The Mead Corporation, Dayton, Ohio

[21] Appl. No.: 249,748

[22] Filed: May 26, 1994

[51] Int. Cl.[6] ..... B65D 5/46

[52] U.S. Cl. ..... 229/117.13; 229/920

[58] Field of Search ..... 229/117.13, 40, 920; 206/141, 427

[56] References Cited

U.S. PATENT DOCUMENTS

| | | | |
|---|---|---|---|
| 4,577,799 | 3/1986 | Oliff | 206/427 |
| 4,588,084 | 5/1986 | Holley, Jr. | 206/427 |
| 4,712,728 | 12/1987 | Schuster | 229/117.13 |
| 4,785,991 | 11/1988 | Schuster | 229/117.13 |
| 4,989,778 | 2/1991 | Saulas | 229/117.13 |
| 5,000,313 | 3/1991 | Oliff | 206/427 |
| 5,221,042 | 6/1993 | Oliff | 229/117.13 |
| 5,234,102 | 8/1993 | Schuster et al. | 229/117.13 |
| 5,297,725 | 3/1994 | Sutherland | 229/117.13 |
| 5,307,932 | 5/1994 | Stout et al. | 229/117.13 |
| 5,320,277 | 6/1994 | Stout et al. | 229/117.13 |

FOREIGN PATENT DOCUMENTS

| | | | |
|---|---|---|---|
| 2274509 | 1/1976 | France | 229/117.13 |

*Primary Examiner*—Gary E. Elkins

*Attorney, Agent, or Firm*—Rodgers & Rodgers

[57] ABSTRACT

The top wall of an article carrier is provided with at least one hand gripping aperture and a number of score lines are arranged to extend from an end of the hand gripping aperture outwardly in a converging path toward corners of the top wall. Diverging cut lines are formed at the outer end of the score lines and diverge from each other as cut lines one of which extends across the top wall and into the adjacent end wall and the other of which extends in the top wall and into the adjacent side wall. The arrangement of diverging score lines in association with converging cut lines constitutes an effective means of distributing the carrier load. By this means the caliber of board used in the formation of the carrier may be substantially reduced and economies thereby effected.

7 Claims, 3 Drawing Sheets

HEAVY DUTY ARTICLE CARRIER

TECHNICAL FIELD

This invention relates generally to hand carried article carriers and is particularly concerned with the construction of hand gripping apertures and related scores and cut lines formed in the top, end and side walls of the carrier.

BACKGROUND ART

This application is related to allowed U.S. application Ser. No. 08/089,710 filed Jul. 9, 1993, now U.S. Pat. No. 5,320,277 and owned by the assignee of this invention.

SUMMARY OF THE INVENTION

A carrier having a rectilinear top wall with opposed end edges and opposed side edges includes side walls having upper edges foldably joined to the side edges of the top wall and end walls having top edges foldably joined with the end edges of the top wall. Score lines emanating from a hand hole aperture converge toward each corner of the top wall and a pair of divergent cut lines emanate from a point adjacent the converging ends of the score lines so as to define a pair of cut lines one of which extends across the top wall and into the adjacent side wall while the other diverging cut line extends from a point adjacent the converged ends of the score lines across the top wall and into the adjacent end wall.

This arrangement is provided at each corner of the top wall and is associated with each side and each end wall to effect a substantial reduction in the distribution of stress when the carrier is carried by hand for example from a point of purchase to a point of use.

Figure 1:
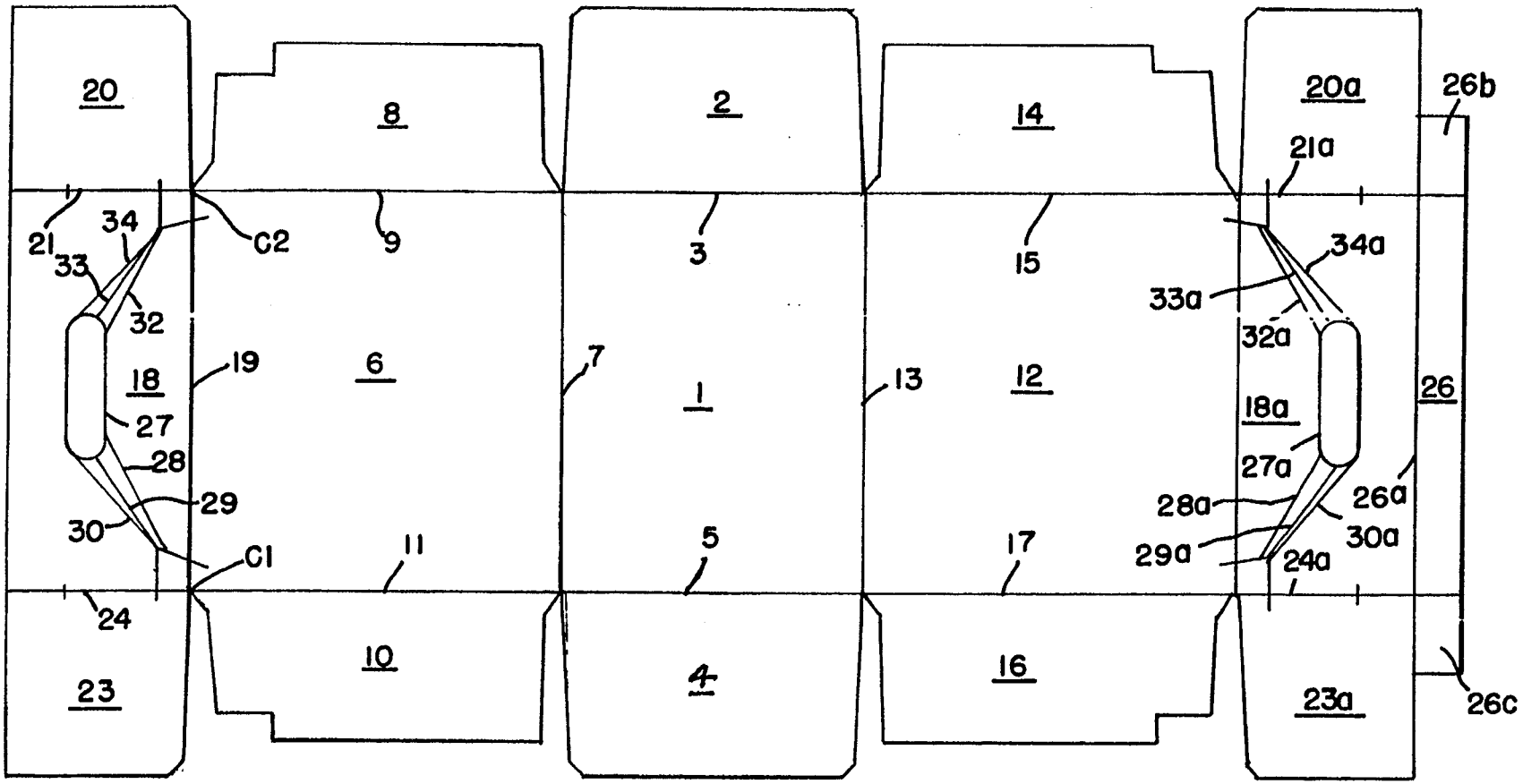
FIG. 1 is a plan view as viewed from the inside of a blank which utilizes this invention.

BEST MODE OF CARRYING OUT THE INVENTION with reference to FIG. 1, the numeral 1 designates the bottom wall of the carrier. Bottom end flap 2 is foldably joined to an end edge of bottom wall 1 along fold line 3. Bottom end flap 4 is foldably joined to bottom wall 1 along fold line 5.

Side wall 6 is foldably joined to a side edge of bottom wall 1 along fold line 7. A side end flap 8 is foldably joined to side wall 6 along fold line 9. Side end flap 10 is foldably joined to side wall 6 along fold line 11.

At the other end of the blank, side wall 12 is foldably joined to bottom wall 1 along fold line 13. Side end flap 14 is foldably joined to side wall 12 along fold line 15. Side wall flap 16 is foldably joined to side wall 12 along fold line 17.

Top wall panel 18 is foldably joined to side wall 6 along a fold line 19. Top end flap 20 is foldably joined to an end edge of top wall panel 18 along fold line 21. At the other end of top wall panel 18 top end flap 23 is foldably joined to top wall panel 18 along fold line 24.

A hand hole aperture 27 is formed in top wall panel 18 and a similar hand hole aperture **27*a* is formed in top wall panel 18*a***.

According to this invention in one form, a plurality of score lines such as 28, 29 and 30 emanate from adjacent one end of hand gripping aperture 27 and converge toward the corner C1 of top wall panel 18.

At the other end of the hand gripping aperture 27, a plurality of score lines 32, 33 and 34 are formed and emanate from a position adjacent one end of hand gripping aperture 27 and converge as they approach the corner C2 of top wall panel 18.

The top panel **18*a* at the opposite end of the blank from top panel 18 is identical to panel 18 in all respects except that reinforcing strip 26 is foldably joined to panel 18*a* along fold line 26*a*. This reinforcing strip has an end portion 26*b* at one end and a similar end portion 26*c* at the other end. The numerals used in connection with top panel 18*a* are duplicates of the numerals used in connection with top panel 18 except for the addition of the suffix a. The top end flaps associated with top wall panel 18*a* are designated by the numerals 20*a* and 23*a***.

Figure 2:
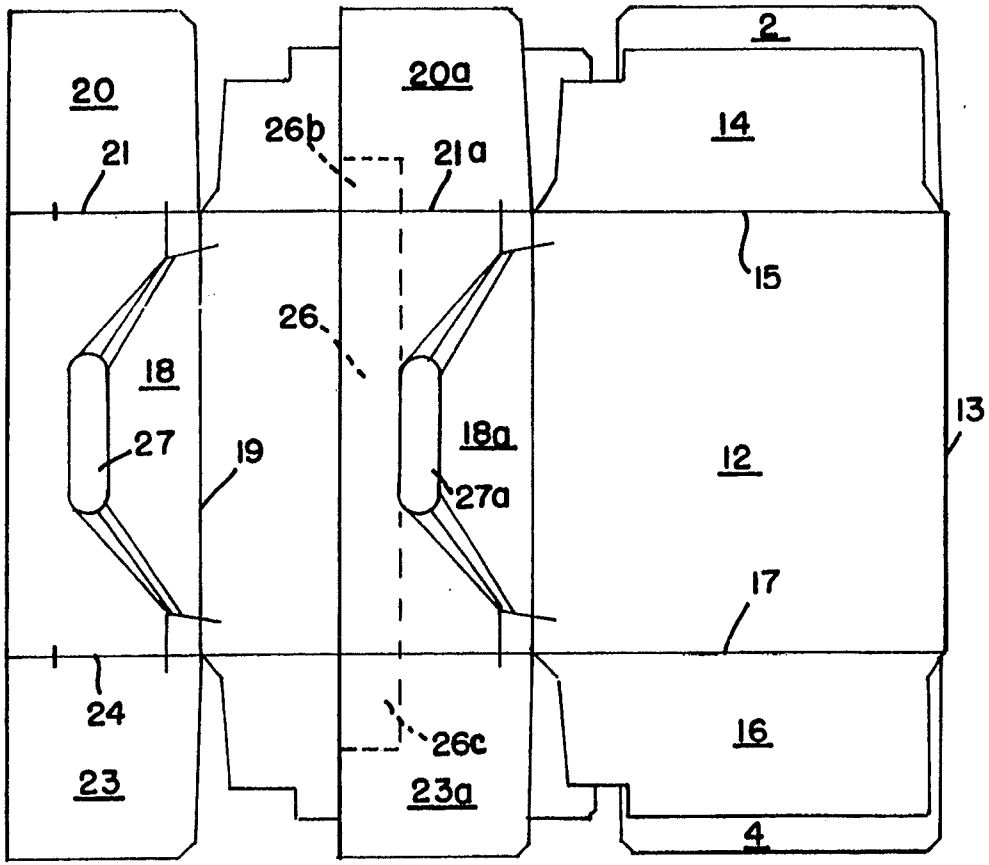

FIG. 2 is a representation of the position of reinforcing strip 26 and its associated end portions **26*b* and 26*c* after folding of panel 26 and ends 26*b* and 26*c* under panels 18*a*, 20*a* and 23*a*. These elements 26, 26*b* and 26*c* are secured by adhesive to the inner surfaces of top panel 18*a* and to the top end flaps 20*a* and 23*a***.

In order to manipulate the carrier blank as shown in FIG. 1 into the partially collapsed condition shown in FIG. 2, the top panel 18a including its end flaps **20*a* and 23*a* and side wall 12 are elevated and folded to the left along fold line 13. Upon completion of this operation the blank appears as shown in FIG. 2**.

Figure 3:
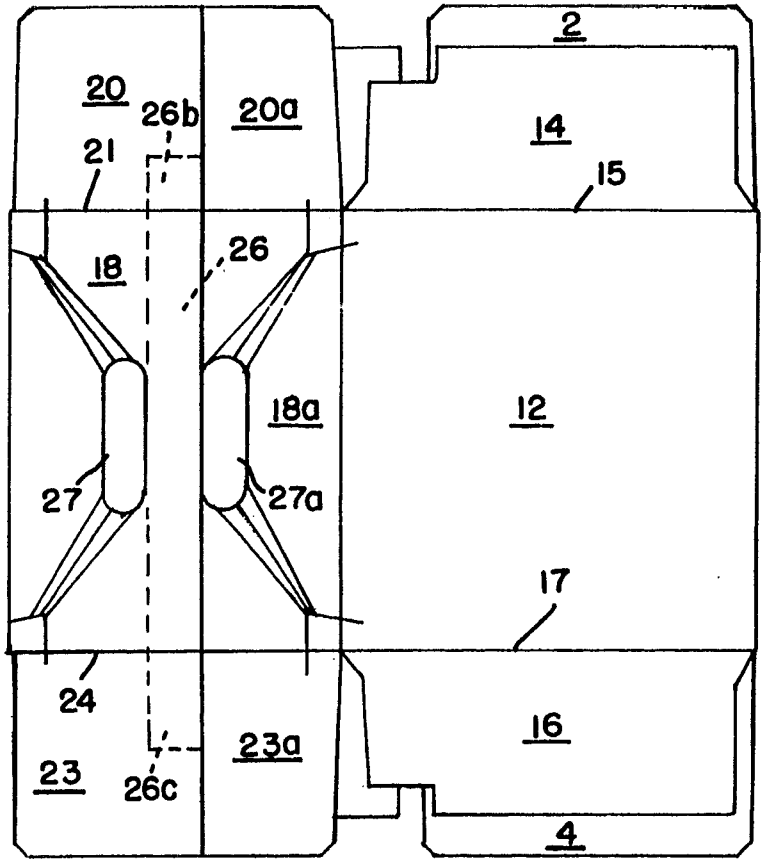
FIGS. 2 and 3 show the blank of FIG. 1 after intermediate folds are completed and FIG. 4 is a set up view of the structure shown in FIG. 3 after the end closure panels and end flaps have been manipulated into fully set up positions.

The blank as shown in FIG. 2 is folded into the condition shown in FIG. 3 by simply folding top wall panel 18 and end flaps 20 and 23 toward the right along fold line 19.

Figure 4:
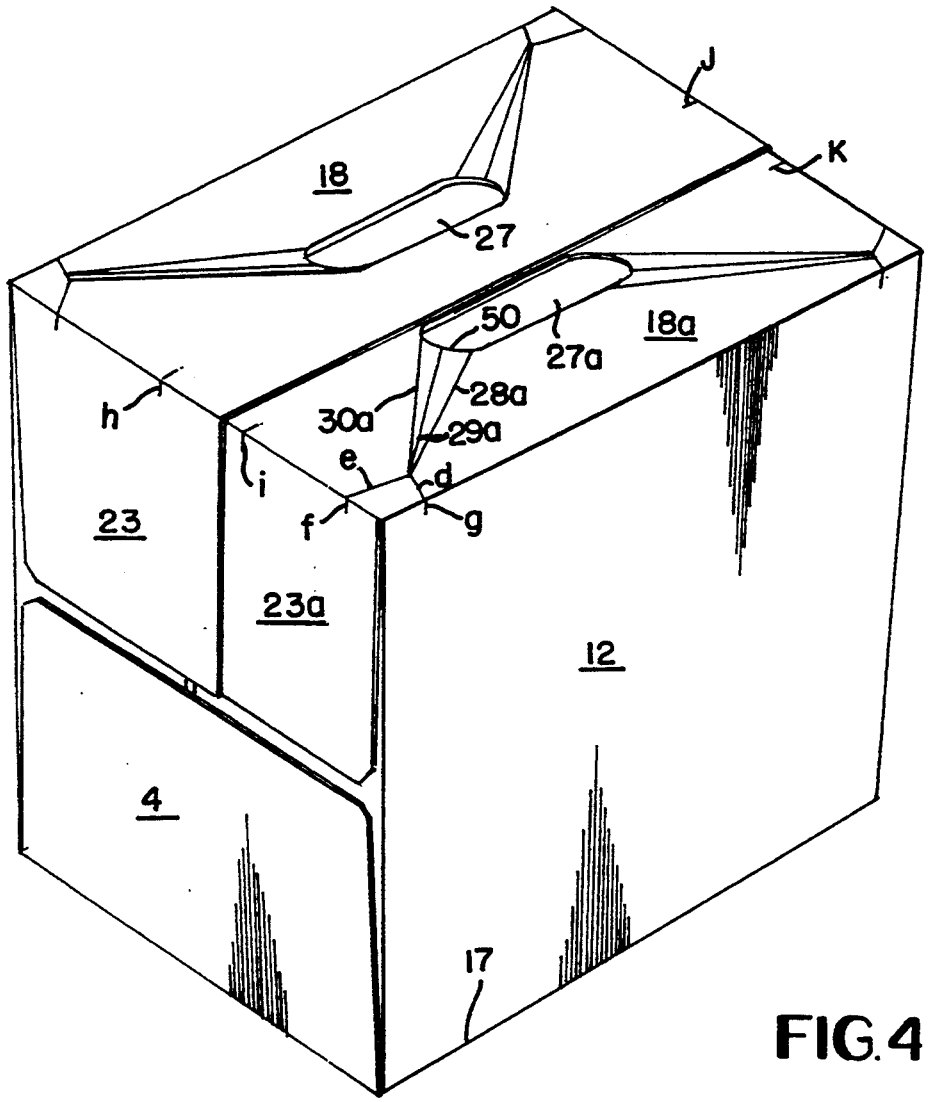

After the carton as shown in collapsed condition in FIG. 3 is set up into open ended tubular condition, the end closure flaps such as 2, 4, 14, 16, 8, 10 as well as 20, **20*a*, 23 and 23*a* are secured in their closed positions as shown in FIG. 4** as is well known in the art.

As is indicated best in FIG. 4, the score lines **28*a*, 29*a*, and 30*a* emanate from the semi-circular end portion 50 of hand hole 27*a* and converge toward their associated cut lines d, e, f and g. These cut lines as is apparent from FIG. 4 are in divergent relation to each other so that the stress delivered at the cut lines d and e by the converged score lines 28*a*, 29*a* and 30*a* is concentrated on cut lines d and e which extend from the top wall panel 18*a* into the end wall 23*a* as indicated at f and into the side wall 12 as indicated at g. Cut line e is approximately parallel with the top edge of side wall 12**. Each cut line such as e, f, d and g comprises a series of aligned cuts interspersed between uncut lines arranged in series with cut lines.

It is thus apparent since the structure associated with top panel **18*a* and with side wall 12 and end wall panel 23*a*** are identical with the structure at the other corners of the carton a description of this feature is not repeated.

It has been found from experience that the effect achieved by this invention effectively distributes the total load so as to reduce the stress imposed by the carton weight at particular points. Of significance also are the cut lines h and i, j and k shown in FIG. 4 and which extend from the end walls into the top wall as is apparent in FIG. 4 without any uncut portions. These spaced apart cuts are disposed astride the end edges of the top wall and the top edges of the end walls and are spaced approximately equidistant from the side edges of the top wall and thereby aid in equalizing the distribution of stress forces in the top and end walls of the carrier.

We claim:

1. An article carrier comprising a bottom wall, a top wall having side and end edges, side walls having end, top and bottom edges and being foldably joined along their bottom edges to side edges of said bottom wall and foldably joined along their top edges to an adjacent side edge of said top wall, end walls having bottom, top and side edges and being foldably joined along their bottom edges to end edges of said bottom wall and foldably joined along their side edges to end edges of the adjacent side and end wall, opposed side edges of said top wall being foldably joined to the top edges of said side walls respectively and having opposed end edges foldably joined respectively to the top edges of said end walls, at least one finger receiving hand hole aperture having opposed ends formed in said top wall, a plurality of converging score lines having converging ends and formed in said top wall and extending from an end of said aperture toward each corner of said top wall and having ends spaced from the associated corner of said top wall, a pair of intersecting divergent cut lines formed in said top wall and extending respectively from the region of said converging ends of said score lines into the adjacent side and end wall.

2. An article carrier according to claim 1 wherein one of said cut lines is approximately parallel to the adjacent side edge of said top wall.

3. An article carrier comprising a bottom wall, side walls having end, top and bottom edges and being foldably joined along their bottom edges to side edges of said bottom wall, end walls having bottom, top and side edges and being foldably joined along their bottom edges to end edges of said bottom wall and foldably joined along their side edges to end edges of said side walls, a top wall having opposed side edges foldably joined to the top edges of said side walls respectively and having opposed end edges foldably joined respectively to the top edges of said end walls, at least one finger receiving hand hole aperture formed in said top wall, a pair of score lines having an inner and an outer end and formed in said top wall and extending from said hand hole aperture toward an associated corner of said top wall and having an outer end spaced from the associated corner of said top wall, a pair of divergent cut lines formed in said top wall and extending from a point of intersection adjacent the outer end of said score line, one of said divergent cut lines extending into the associated corner of the adjacent side wall and the other of said divergent cut lines extending into the associated corner of the associated end wall.

4. An article carrier according to claim 3 wherein each of said divergent cut lines intersects an end edge and a side edge of said top wall at approximately equal distances from said associated corner of said top wall.

5. An article carrier according to claim 3 wherein said divergent cut lines comprise a series of aligned cuts interspersed between uncut lines arranged in series with said cut lines.

6. An article carrier according to claim 3 wherein said aperture includes a pair of parallel side edges and opposed end edges of semicircular configuration and wherein the inner ends of said score lines intersect an end of said aperture and converge in the direction of the point of intersection of said divergent cut lines.

7. An article carrier according to claim 1 wherein a pair of spaced apart cuts are disposed astride the fold lines between said top wall and each end wall and are spaced approximately equidistant from the side edges of said top wall.

* * * * *